US009921009B2

(12) United States Patent
Zug

(10) Patent No.: US 9,921,009 B2
(45) Date of Patent: Mar. 20, 2018

(54) DUAL-USE RAM-PRIMARY/REGEN HX

(71) Applicant: HONEYWELL INTERNATIONAL INC., Morris Plains, NJ (US)

(72) Inventor: Andrew Zug, Costa Mesa, CA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 25 days.

(21) Appl. No.: 15/096,486

(22) Filed: Apr. 12, 2016

(65) Prior Publication Data

US 2016/0305683 A1 Oct. 20, 2016

Related U.S. Application Data

(60) Provisional application No. 62/147,989, filed on Apr. 15, 2015.

(51) Int. Cl.

| | |
|---|---|
| ***F28F 27/00*** | (2006.01) |
| ***F28F 13/00*** | (2006.01) |
| ***F28F 27/02*** | (2006.01) |
| ***F28D 19/00*** | (2006.01) |
| *F28D 21/00* | (2006.01) |

(52) U.S. Cl.
CPC ..... *F28F 13/00* (2013.01); *F28D 19/00* (2013.01); *F28D 21/0001* (2013.01); *F28F 27/02* (2013.01); *F28D 2021/0021* (2013.01)

(58) Field of Classification Search
CPC ..... F28F 13/00; F28F 27/02; F28D 19/00; F28D 21/0001; F28D 2021/0021
USPC ..... 165/96
See application file for complete search history.

(56) References Cited

U.S. PATENT DOCUMENTS

| | | | | |
|---|---|---|---|---|
| 4,041,723 A * | 8/1977 | Weibel, Jr. | ..... | F24F 1/027 62/126 |
| 4,997,029 A * | 3/1991 | Otsuka | ..... | F24F 3/044 165/11.1 |
| 7,171,819 B2 | 2/2007 | Lui et al. | | |
| 2009/0107173 A1* | 4/2009 | Yoon | ..... | F25B 31/004 62/510 |

* cited by examiner

*Primary Examiner* — Davis Hwu
(74) *Attorney, Agent, or Firm* — Shimokaji IP

(57) ABSTRACT

A regenerative heat exchanger includes an inlet and an outlet in communication with the inlet. The heat exchanger is configured to operate in two modes. A first mode uses only an ambient flow to cool a hot flow and a second mode uses both the ambient flow and a regenerative flow to cool the hot flow.

18 Claims, 2 Drawing Sheets

DUAL-USE RAM-PRIMARY/REGEN HX

BACKGROUND OF THE INVENTION

The present invention generally relates to heat exchangers and, more particularly, to apparatus and methods of using regenerative and ambient flows into heat exchangers.

Many environmental control systems (ECS) utilize "regenerative" flow to cool the cycle operating fluid. Regenerative flow is conditioned air or liquid flow that has been cooled, and then used to perform high-quality (i.e., low temperature) cooling of system heat loads. After the flow has performed this cooling, it is warm, but still cooler than the fluid temperature at the hot portions of the cycle. Because of this, the flow can be used to "self-cool" the cycle hot fluid. After it is thus used, it is then very hot and no longer useful for cooling, and is typically rejected to ambient as waste heat.

To perform this regenerative cooling, heat exchangers are needed. These heat exchangers are often used to supplement other heat exchangers that directly use external ambient fluid (e.g., air, water) to cool the working cycle fluid. By supplementing the main, ambient fluid heat exchangers with the regenerative heater exchangers, it is possible to reduce the size of the main ambient heat exchangers, and the amount of ambient fluid that is used. This offers benefits in terms of system weight and outside power or aerodynamic drag.

At some design conditions, it is common for the regenerative flow to be limited due to the scarcity of working fluid (for example, during low engine settings for cycles using bleed air from jet engines.) At these design conditions, the benefit from the regenerative heat exchangers will be significantly reduced or completely eliminated, which reduces the sizing benefit that can be granted to the other main heat exchangers.

As can be seen, there is a need for improved apparatus and methods for regenerative heat exchange.

SUMMARY OF THE INVENTION

In one aspect of the present invention, a heat exchanger comprises an inlet; and an outlet in communication with the inlet, wherein the heat exchanger is configured to operate in two modes: wherein a first mode uses only an ambient flow to cool a hot flow; and wherein a second mode uses both the ambient flow and a regenerative flow to cool the hot flow.

In another aspect of the present invention, a cross flow heat exchanger comprises an inlet; an outlet in communication with the inlet; wherein the heat exchanger is configured to enable heat exchange between a hot flow and a mixture of ambient flow and regenerative flow; and wherein the heat exchanger is configured to vary the amount of regenerative flow from zero flow to full flow.

In yet another aspect of the present invention, an environmental control system comprises a regenerative heat exchanger configured to put an ambient flow in cross-flow communication with a hot flow; and wherein the regenerative heat exchanger is configured to provide varying mixtures of ambient flow and regenerative flow in heat exchange relationship with the hot flow.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Generally, the present invention provides a simple means to use regenerative heat exchangers even during conditions with limited or no regenerative flow by making them dual-use regenerative/ambient heat exchangers. The present invention eliminates the need for multiple flow control devices (e.g., valves) and ducting to control both the regenerative flow and the ambient fluid flow, and thus removes undesirable pressure losses within the ambient fluid circuit that restricts flow. The present invention makes use of a single regenerative flow control device to effect the same control, without restriction of ambient flow during conditions when no regenerative flow is available.

Moreover, the present invention can replace separate ambient-cooled and regeneratively-cooled heat exchangers with one or more heat exchangers placed in the ambient fluid circuit. When there is no regenerative flow, the full extent of the heat exchangers can be used to cool the working fluid with ambient air being forced through the circuit.

When regenerative air is available, the regenerative air can be injected into the ambient fluid circuit. This injection can be done in a way to optimize the flow pattern so that the temperature and flow profile within the ambient fluid circuit matches the thermodynamic optimum cycle. Specifically, for cross-flow heat exchangers, an optimum distribution of cooling fluid places the colder fluid on the side nearest the hot fluid side outlet.

Thus, for regenerative flows that are typically colder than the ambient fluid at the heat exchanger inlet, the regenerative flow will be injected to flow along the side of the ambient air circuit on the hot-fluid outlet side. For regenerative flows that are typically hotter than the ambient fluid, the regenerative flow would be injected to flow along the side of the ambient air circuit on the hot-fluid inlet side. This flow and temperature stratification within the ambient fluid circuit can effectively achieve the cooling performance of separate regenerative/ambient air circuits without introducing extra equipment or circuit obstructions.

Figure 1:
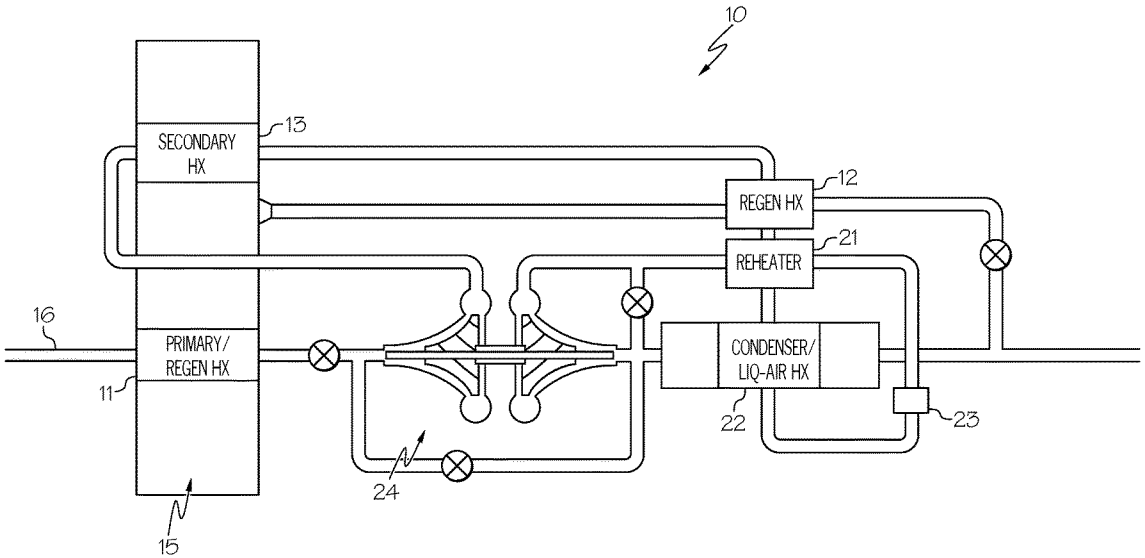
FIG. 1 is a schematic view of an environmental control system according to an embodiment of the present invention.

FIG. 1 is a schematic depiction of an exemplary environmental control system (ECS) 10 that can be used, for example, in vehicles such as aircraft. The ECS 10 can include a first regenerative heat exchanger 11 and/or a second regenerative heat exchanger 12 that is downstream of the first regenerative heat exchanger 11. In embodiments, the first regenerative heat exchanger 11 can be a primary heat exchanger.

In embodiments, the ECS 10 may further include a reheater 21 downstream of the second regenerative heat exchanger 12, a condenser 22 downstream of the heat exchanger 12, and a water extractor 23 downstream of the condenser 22. An air cycle machine 24 may be downstream of the primary heat exchanger 11 and the reheater 21. However, the present invention contemplates that one or more regenerative heat exchangers of the present invention can be used in other configurations of an ECS.

Figure 2:
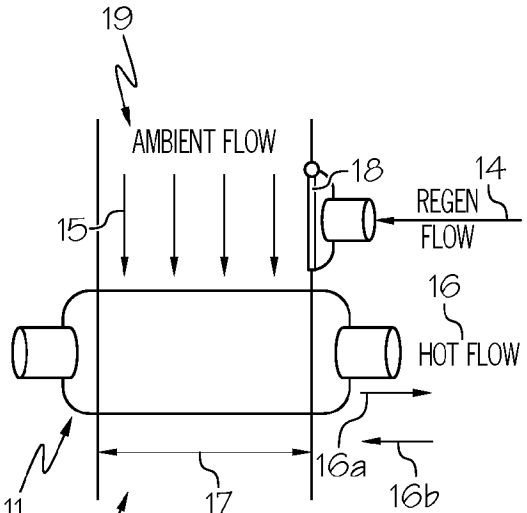
FIG. 2 is a schematic view of a regenerative heat exchanger in a closed mode according to an embodiment of the present invention.

In FIG. 2, according to various embodiments, the regenerative heat exchangers 11 and/or 12 may be of a cross-flow type. Accordingly, and only for purposes of illustrating both heat exchangers, the heat exchanger 11 may receive one flow 15, such as ambient air flow, at an inlet 19 of the heat exchanger 11 and exit at an outlet 20 thereof. The heat exchanger 11 may also receive a second flow 16, such as a hot flow, wherein the first and second flows 15, 16 pass through the heat exchanger 11 in a generally perpendicular orientation to one another.

In embodiments, the ambient flow 15 may originate from a ram scoop or fan circuit, as an example. The ambient flow 15 may exit the heat exchanger 11 and flow directly overboard or be used to ventilate other areas of the aircraft, as an example.

In embodiments, the hot flow 16 may originate from an aircraft bleed system or ECS air cycle machine, as an example. The hot flow 16 may exit the heat exchanger and flow directly into an ECS air cycle machine or water separate equipment, as an example.

In embodiments, the regenerative heat exchanger 11 may further include a flow control device 18, such as a valve, that can adjust the cross sectional area or amount of the hot flow 16 that is cooled by a regenerative flow 14 which may originate from a load such as the cabin of an aircraft and/or electronics of an aircraft.

The cooled amount of the hot flow 16 can be anywhere from zero to a majority thereof. This can be achieved by adjusting the control device 18 which, in turn, can adjust a size of an opening 18*a*, for the regenerative flow, 14 into the heat exchanger 11. The control device 18 can also adjust a direction of the regenerative flow 14 so that a cross sectional area or amount of the hot flow 16 that is cooled by the regenerative flow 14 can be adjusted. In embodiments, the control device 18 may be manually controlled or automatically controlled.

In FIG. 2, the control device 18 is depicted in a closed position or mode. In other words, the opening 18*a* is completely closed and the heat exchanger 11 is operating in a closed mode. In such instance, absolutely no or essentially no regenerative flow 14 is entering the heat exchanger 11, and only the ambient flow 15 is cooling the hot flow 16. Thus, a cross-sectional area 17 of the hot flow 16 is being entirely cooled by the ambient flow 15.

In embodiments, the ECS 10 may be configured so that the regenerative flow 14 may be hotter than the ambient flow 15. In such instance, the ECS 10 may be configured so that the hot flow 16 may flow in a first direction 16*a*. On the other hand, the ECS 10 may be configured so that the regenerative flow 14 may be colder than the ambient flow 15. In such instance, the ECS 10 may be configured so that the hot flow 16 may flow in a second direction 16*b*.

Figure 3:
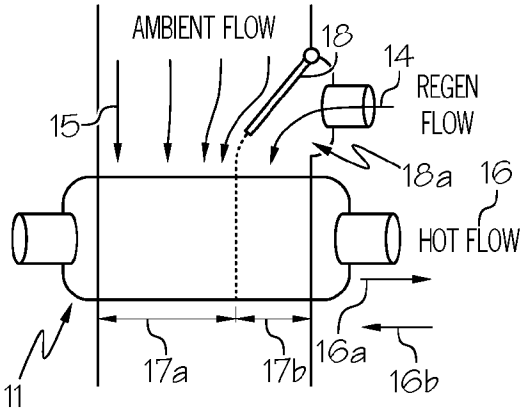
FIG. 3 is a schematic view of a regenerative heat exchanger in an operating mode according to an embodiment of the present invention.

In FIG. 3, the control device is depicted in a partially open position or mode. In other words, the opening 18*a* is partially open and the heat exchanger 11 is operating in a partially open mode. In that instance, a full regenerative flow 14 is entering the heat exchanger 11, but less than a majority of the cross sectional area of the hot flow 16 is being cooled. Accordingly, in the partially open mode, a mixture of ambient flow 15 and regenerative flow 14 is cooling the hot flow 16. Thus, a first cross sectional area 17*a* of the hot flow 16 is being all or mostly cooled by the ambient flow 15. At the same time, a second cross sectional area 17*b* of the hot flow is being all or mostly cooled by the regenerative flow 14. In an embodiment, the first cross sectional area 17*a* is larger than the second cross sectional area 17*b*.

Still referring to FIG. 3, in embodiments and as described above, the regenerative flow 14 may be hotter than the ambient flow 15. In such instance, the ECS 10 may be configured so that the hot flow 16 may flow in first direction 16*a*, and the regenerative flow 14 may pass through and adjacent a side of the heat exchanger 11 that is adjacent an outflow of the hot flow 16. On the other hand, when the regenerative flow 14 may be colder than the ambient flow 15, the ECS 10 may be configured so that the hot flow 16 may flow in a second direction 16*b*, and the regenerative flow 14 may pass through and adjacent a side of the heat exchanger 11 that is adjacent an inflow of the hot flow 16.

Figure 4:
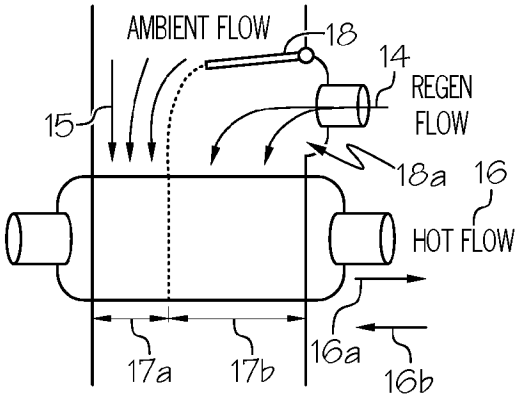
FIG. 4 is a schematic view of a regenerative heat exchanger in another operating mode according to an embodiment of the present invention.

In FIG. 4, the control device is depicted in a fully open position or mode. In other words, the opening 18*a* is fully open and the heat exchanger 11 is operating in a fully open mode. In that instance, a full flow of the regenerative flow 14 is entering the heat exchanger 11, as in the partially open mode. Accordingly, in the fully open mode, a mixture of ambient flow 15 and regenerative flow 14 is cooling the hot flow 16. However, in contrast to the partially open mode, the regenerative flow 14 is cooling a majority of the cross-sectional area of the hot flow 16.

Thus, a first cross sectional area 17*a* of the hot flow 16 is being all or mostly cooled by the ambient flow 15. At the same time, a second cross sectional area 17*b* of the hot flow is being all or mostly cooled by the regenerative flow 14. In an embodiment, the second cross sectional area 17*b* is larger than the first cross sectional area 17*a*.

Still referring to FIG. 4, in embodiments as described above, the regenerative flow 14 may be hotter than the ambient flow 15. In such instance, the ECS 10 may be configured so that the hot flow 16 may flow in direction 16*a*, and the regenerative flow 14 may pass through and at a side of the heat exchanger 11 adjacent an outflow of the hot flow 16. On the other hand, when the regenerative flow 14 may be colder than the ambient flow 15, the ECS 10 may be configured so that the hot flow 16 may flow in a direction 16*b*, and the regenerative flow 14 may pass through and adjacent a side of the heat exchanger 11 that is adjacent an inflow of the hot flow 16.

As can be appreciated, as the control device 18 moves from a closed position to a fully open position, the cross sectional area of the hot flow being cooled by the regenerative flow 14 increases. Similarly, as the control device 18 moves from a fully open position to a closed position, the cross sectional area of the hot flow being cooled by the regenerative flow 14 decreases.

It should be understood, of course, that the foregoing relates to exemplary embodiments of the invention and that modifications may be made without departing from the spirit and scope of the invention as set forth in the following claims.

I claim:

1. A heat exchanger, comprising:

an inlet; and an outlet in communication with the inlet, wherein the heat exchanger is configured to operate in two modes:

wherein a first mode uses only an ambient flow to cool a hot flow in the heat exchanger, wherein the ambient flow is air from outside of an environment to be cooled by the heat exchanger;

wherein a second mode uses both the ambient flow and a regenerative flow to cool the hot flow in the heat exchanger;

wherein the ambient flow, the hot flow and the regenerative flow are each from different sources;

wherein the ambient flow provides heat exchange, selectively, for:

an entire cross section of the hot flow in the heat exchanger; and a first cross section of the hot flow in the heat exchanger when the regenerative flow provides heat exchange with a second cross section of the hot flow in the heat exchanger.

2. The heat exchanger of claim 1, wherein the heat exchanger is configured to operate in three modes.

3. The heat exchanger of claim 1, wherein the heat exchanger is configured to operate in a closed mode, a partially open mode, and a fully open mode.

4. The heat exchanger of claim 1, wherein the first cross section is larger than the second cross section.

5. The heat exchanger of claim 1, wherein the first cross section is smaller than the second cross section.

6. A cross-flow heat exchanger, comprising:

an inlet;

an outlet in communication with the inlet;

wherein the heat exchanger is configured to enable heat exchange between a hot flow in the heat exchanger and a mixture in the heat exchanger of ambient flow and regenerative flow;

wherein the ambient flow is air from outside of an environment to be cooled by the heat exchanger;

wherein the regenerative flow is air from inside of the environment to be cooled by the heat exchanger;

wherein the ambient flow, the hot flow and the regenerative flow are each from different sources;

wherein the heat exchanger is configured to vary the amount of regenerative flow from zero flow to full flow;

wherein the heat exchanger is configured to vary a regenerative cross section of the hot flow in the heat exchanger that is cooled by the regenerative flow and to vary an ambient cross section of the hot flow in the heat exchanger that is cooled by the ambient flow.

7. The heat exchanger of claim 6, further comprising a control device to control an amount of regenerative flow into the heat exchanger.

8. The heat exchanger of claim 7, wherein the control device operates in a closed mode, a partially open mode, and a fully open mode.

9. The heat exchanger of claim 7, wherein the control device adjusts a size of an opening for passage of the regenerative flow into the heat exchanger.

10. The heat exchanger of claim 6, wherein the ambient flow moves in a cross flow direction to the hot flow.

11. The heat exchanger of claim 6, wherein the regenerative flow moves in a cross flow direction to the hot flow.

12. An environmental control system (ECS), comprising:

a regenerative heat exchanger configured to put, therein, an ambient flow in cross-flow communication with a hot flow;

wherein the hot flow is air from outside of an environment to be cooled by the heat exchanger;

wherein the regenerative heat exchanger is configured to provide varying mixtures of ambient flow and regenerative flow in heat exchange relationship with varying cross sections of the hot flow in the regenerative heat exchanger;

wherein the ambient flow, the hot flow and the regenerative flow are each from different sources.

13. The ECS of claim 12, wherein a load provides the regenerative flow and the load is one of an aircraft cabin and electronics.

14. The ECS of claim 13, wherein the regenerative flow exits the cabin.

15. The ECS of claim 12, wherein the regenerative heat exchanger is configured to put the regenerative flow in cross-flow communication with the hot flow.

16. The ECS claim 12, wherein the ambient flow moves parallel with the regenerative flow.

17. The ECS of claim 12, wherein an amount of regenerative flow varies between zero flow and full flow.

18. The ECS of claim 12, wherein the regenerative flow passes within and at a side of the heat exchanger that is adjacent one of an inflow of the hot flow and an outflow of the hot flow.

* * * * *